US009338568B2

(12) United States Patent
van Hal

(10) Patent No.: US 9,338,568 B2
(45) Date of Patent: May 10, 2016

(54) INFLATABLE EAR PIECE AND A METHOD OF ITS MANUFACTURE

(71) Applicant: Sonion Nederland B.V., Hoofddorp (NL)

(72) Inventor: Paul Christiaan van Hal, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/061,023

(22) Filed: Oct. 23, 2013

(65) Prior Publication Data

US 2014/0119585 A1 May 1, 2014

Related U.S. Application Data

(60) Provisional application No. 61/718,287, filed on Oct. 25, 2012.

(51) Int. Cl.
*H04R 25/00* (2006.01)

(52) U.S. Cl.
CPC ..... *H04R 25/652* (2013.01); *H04R 25/65* (2013.01); *H04R 25/656* (2013.01); *H04R 25/658* (2013.01); *H04R 2225/025* (2013.01)

(58) Field of Classification Search
CPC ..... A61L 2/186; H04R 1/1016; H04R 25/65; H04R 25/652; H04R 25/656; H04R 25/658; H04R 2225/021; H04R 2225/023; H04R 2225/025; A61F 11/08; A61F 11/10
USPC ..... 381/322, 324, 328, 329, 330, 380, 381, 381/382; 181/129, 130, 135; 128/864, 865; 29/896.21
See application file for complete search history.

(56) References Cited

U.S. PATENT DOCUMENTS

| | | | | |
|---|---|---|---|---|
| 2,938,237 | A * | 5/1960 | Kern et al. | 264/163 |
| 2,959,820 | A * | 11/1960 | Miller et al. | 264/310 |
| 3,134,831 | A * | 5/1964 | De Fusco et al. | 264/161 |
| 6,129,175 | A * | 10/2000 | Tutor et al. | 181/135 |
| 6,339,648 | B1 * | 1/2002 | McIntosh et al. | 381/328 |
| 7,362,875 | B2 * | 4/2008 | Saxton et al. | 381/322 |
| 7,425,196 | B2 | 9/2008 | Jorgensen et al. | |
| 2009/0071486 | A1 * | 3/2009 | Perez et al. | 128/858 |
| 2009/0071487 | A1 * | 3/2009 | Keady | 128/864 |
| 2012/0155694 | A1 * | 6/2012 | Reeuwijk et al. | 381/396 |

* cited by examiner

*Primary Examiner* — Huyen D Le
(74) *Attorney, Agent, or Firm* — Nixon Peabody LLP

(57) ABSTRACT

An inflatable ear piece is used in a hearing aid. The inflatable ear piece defines an inflatable part, which defines an inflatable cavity. The inflatable cavity, when inflated, defines an inflated state in which the inflatable part abuts an inner wall of an auditory canal when provided therein, and, when deflated to a deflated state, allows for insertion and/or retraction of the ear piece from the auditory canal. The inflatable ear piece comprises one or more biasing means that are arranged to bias the inflatable part away from a totally collapsed state and into the deflated state. The biasing means is secured to an inner wall of the inflatable cavity.

9 Claims, 1 Drawing Sheet

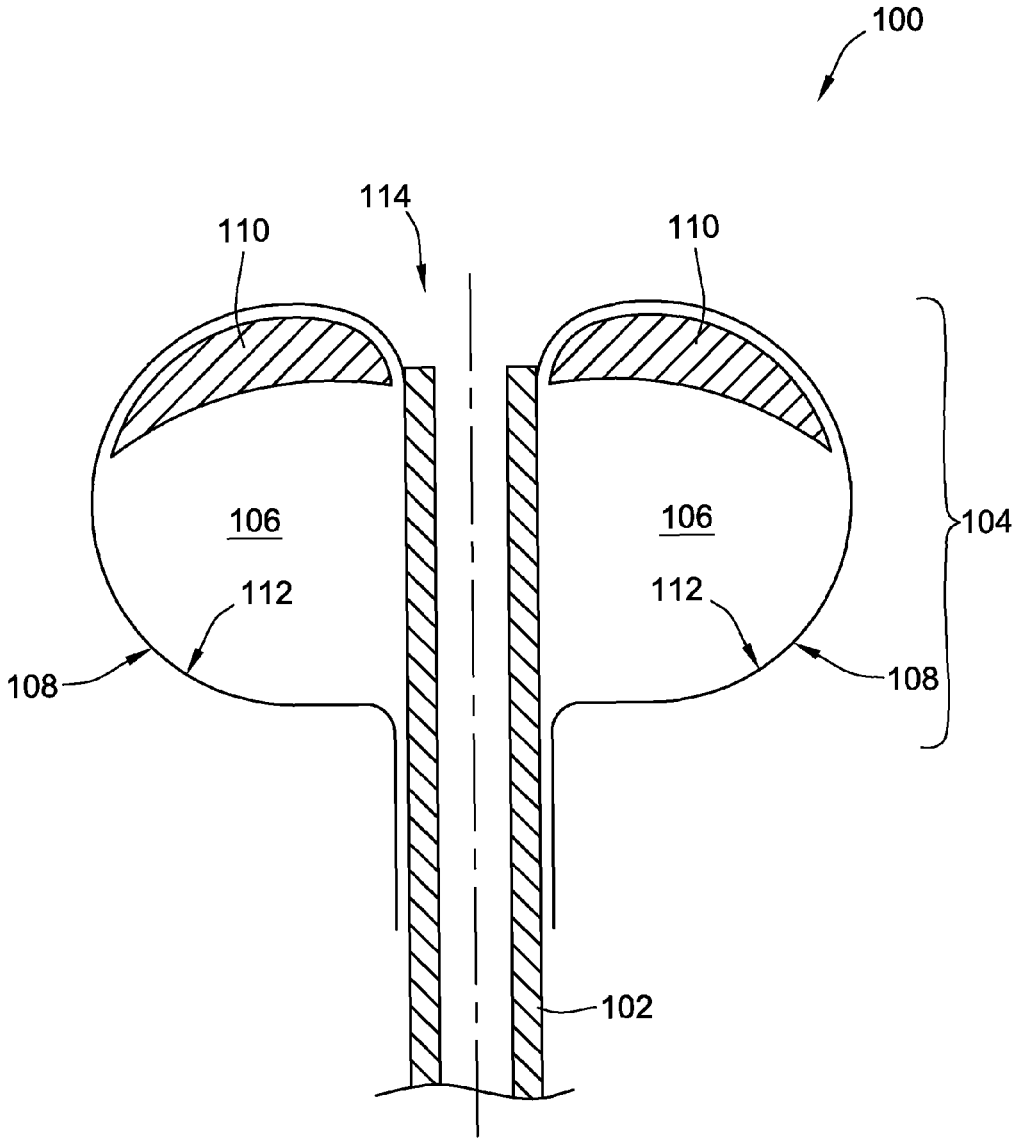
100
114
110
110
106
106
104
112
112
108
108
102

INFLATABLE EAR PIECE AND A METHOD OF ITS MANUFACTURE

CROSS-REFERENCE TO RELATED APPLICATION

This application claims the benefit of U.S. Provisional Patent Application No. 61/718,287, filed Oct. 25, 2012, entitled "An Inflatable Ear Piece and a Method of Its Manufacture" which is hereby incorporated by reference in its entirety.

FIELD OF THE INVENTION

The present invention relates to a method of manufacturing an inflatable ear piece comprising an inflatable cavity in which a cured curable material is provided.

BACKGROUND OF THE INVENTION

Hearing aids comprising ear pieces which are to be secured in the auditory canal of the user, may comprise an expandable part which is expanded in order to secure the ear piece in the auditory canal of the user. Such an expandable part is used instead of common ear domes made of stiff silicone or polyurethane and provides increased comfort and fitting rate for hearing aid users. In order to position such an expandable ear piece, it is brought in a compressed state to allow insertion into the ear canal. U.S. Pat. No. 7,362,875 discloses an expandable ear piece having a frame to facilitate compressing and expanding of the ear piece. Prior to insertion into the ear canal, the ear piece is compressed by the user. Once inserted, the frame expands and conforms to the ear canal. A drawback is that a specifically constructed frame is required.

U.S. Pat. No. 7,425,196 discloses an expandable ear piece having a balloon capable of being inflated and deflated. Prior to insertion into the ear canal, the balloon is brought in a deflated state. Once inserted, the balloon is inflated by pumping air into the balloon, which thus expands and conforms to the ear canal. However, in the deflated state the balloon is highly flexible and pliable and hence is difficult to be inserted in the ear canal.

From an auditory usability point of view, it is desirable that the walls of the inflatable part are as thin as possible, as this reduces the occlusion effect. Furthermore, a very thin wall material provides a better seal as compared to a thicker foil as it conform to the ear canal more easily.

However the thinner the wall is, its unfolding will be nosier from a completely collapsed state. Moreover, as the ear piece is unfolded inside the auditory canal (i.e., close to the ear drum), even low levels of noise will be perceived as uncomfortable by the user.

It is an object of one or more embodiments of the present invention, to provide an ear piece for a hearing aid which alleviates the above drawbacks

DESCRIPTION OF THE INVENTION

In a first aspect, the present invention relates to a method of manufacturing an inflatable ear piece for a hearing aid, which inflatable ear piece is adapted to be inserted into an auditory canal of a user. The inflatable ear piece defines an inflatable cavity, which (i) when inflated defines an inflated state in which the inflatable ear piece abuts an inner wall of the auditory canal, and (ii) when deflated defines a deflated state in which it allows for insertion and/or refraction of the inflatable ear piece from the auditory canal. The method comprises the steps of providing the inflatable ear piece, and providing a predetermined material in the inflatable cavity. The method further includes securing the predetermined material to an inner surface of the inflatable cavity so as to bias the inflatable cavity away from a totally collapsed state.

By providing and securing the predetermined material to the inner surface of the inflatable cavity, the inflatable cavity is biased at least partly away from a totally collapsed state. This provides the advantage that the inflatable ear piece may be prevented from being creased too much together in a very compact configuration. This is also advantageous as it reduces the noise stemming from the unfolding of the ear piece from the very compact (and creased together) configuration to the less compact (slightly unfolded) configuration.

Normally, the noise level of such walls during unfolding is high if the walls are thin compared to when they are thicker. Thus, by biasing the walls away from a totally compact (and creased together) configuration, the walls may be made thinner (which normally is nosier but due to the biasing effect of the predetermined biasing material, the initial very nosy part of the unfolding process is avoided).

A further advantage is that when the ear piece suffers from leakage, i.e. air very gradually escaping from the balloon, the biased walls still exert a retention force keeping the ear piece in place.

In the context of the present invention, the inflatable cavity defines at least three states, a 'totally collapsed state', a 'deflated state' and an 'inflated state'.

The 'totally collapsed state' is the state which the inflatable cavity would be in, if all—or substantially—air was removed from the inflatable cavity and if—at the same time—the predetermined material was not arranged to bias the inflatable cavity away from this state, i.e. the abovementioned totally compacted configuration.

The 'deflated state' is the state which the inflatable cavity is in, when the atmospheric pressure inside the inflatable cavity is (substantially) equal to the ambient atmospheric pressure outside the inflatable cavity. Atmospheric pressure shall be understood to be a pressure measured in Bar, Pascal etc.

Finally, the 'inflated state' is a state which the inflatable cavity is in when the atmospheric pressure inside the inflatable cavity is larger than the ambient atmospheric pressure outside the inflatable cavity. The 'inflated state' covers any atmospheric pressure inside the inflatable cavity which is larger than the ambient atmospheric pressure.

The inflatable ear piece is adapted to be inserted into the auditory canal of a user and to be retained therein by blowing air in to the inflatable cavity. In use, the inflatable ear piece is inserted into the auditory canal when the inflatable cavity is in its deflated state. Once inserted into the auditory canal, air may be blown into the inflatable cavity such that the circumferential extent of the inflatable ear piece increases as the ear piece expands. When the desired size of the inflatable ear piece is achieved and/or the desired pressure by the ear piece against the inner wall of the auditory canal is achieved, the process of pumping air into the inflatable cavity is halted. When at a later stage the user wants to remove the inflatable ear piece or if too much air has been pumped into the inflatable cavity, air will be allowed to escape from the inflatable cavity such that the circumferential extent of the inflatable ear piece decreases.

The method according to the present invention comprises the steps of providing the inflatable ear piece, providing a predetermined material in the inflatable cavity (of the inflatable ear piece), and securing the predetermined material to an inner surface of the inflatable cavity so as to bias the inflatable cavity away from a totally collapsed state.

In one embodiment, the steps are carried out in the above order.

In one embodiment, the step of 'providing the predetermined material' comprises the step of pouring the predetermined material into the inflatable cavity. It will be appreciated that in order to be able to pour the predetermined material into the inflatable cavity, the predetermined material must be on liquid form during the process of pouring. In another embodiment, the step of 'providing the predetermined material' comprises the step of: providing the predetermined material in liquid form in the inflatable cavity.

In one embodiment, the inflatable cavity defines an opening into which the predetermined material is poured during the step of 'providing the predetermined material'. In another embodiment, a tube is inserted into the opening and the predetermined material is filled into the inflatable cavity through this tube. One advantage of the latter is that the predetermined material will not flow along inner surfaces of the inflatable cavity when it is poured into the inflatable cavity. This may be desirable in cases where the predetermined material shall only be provided in e.g. a bottom part of the inflatable cavity and not on side surfaces extending between the bottom part and the opening.

In one embodiment, the predetermined material is a curable material. In one embodiment, the curable material comprises a polymer or rubber such as natural rubber and/or synthetic rubber. The curable material may be a silicone gel.

In one embodiment, the step of 'securing the predetermined material' comprises the step of curing the curable material. The curable material may be adapted to cure when subjected to air. Alternatively, or as a supplement, the curable material will cure when subjected to thermal energy. Alternatively, or as a supplement, the curable material may be caused to cure when subjected to Ultraviolet or Infrared radiation. The radiation may be provided by subjecting the entire inflatable ear piece to the radiation e.g. such that the radiation is transmitted through the ear piece and into the curable material. Alternatively, or as a supplement, a radiation emitting device may be inserted into the opening of the inflatable cavity such that the radiation may be radiated directly onto the curable material and not through the walls of the inflatable cavity.

Prior to the providing the predetermined material in the inflatable cavity, the viscosity of the material may be lowered such that the predetermined material flows more easily. This may be done by adding a solvent to the predetermined material, which evaporates subsequently whereby the viscosity of the curable material returns to its initial level. Alternatively, or as a supplement, the temperature of the predetermined material may be elevated so as to lower the viscosity and thus make the predetermined material flow more easily.

It will be appreciated that by placing the inflatable cavity in a predetermined orientation, the curable material may be secured/anchored in a predetermined position inside the inflatable cavity. Thus, in one embodiment, the step of 'curing the curable material' comprises the step of positioning the inflatable ear piece such that the curable material is located in a predetermined position, and curing the curable material while it is provided in the predetermined position. As an example, the inflatable ear piece may be positioned with its bottom facing downwards whereby the curable material when filled into the cavity will be positioned in the area of the bottom. If then the curable material is cured while it is positioned in the bottom part of the inflatable cavity, then it will be secured to the bottom of the inner wall of the inflatable cavity.

In some cases, it is desirable to have the curable material distributed over a larger area of the inflatable cavity. In such cases, the step of 'curing the curable material' may comprise the step of continuously rotating the inflatable ear piece while curing the curing material. In the latter case the inflatable cavity may, after the curable material has been filled into the cavity, be orientated such that a horizontal line extends through the opening and the bottom. If in that case, the inflatable cavity is rotated about this horizontal line while the material is cured, then the curable material is applied and fastened to the side surfaces of the inflatable cavity.

In a second aspect, the present invention relates to an inflatable ear piece for a hearing aid which inflatable ear piece is adapted to be positioned in an auditory canal of the user and to be connected to a behind-the-ear part via at least an interconnecting tube. The inflatable ear piece defines an inflatable part, which defines an inflatable cavity that (i) when inflated defines an inflated state in which the inflatable part abuts an inner wall of an auditory canal when provided therein, and (ii) when deflated defines a deflated state in which it allows for insertion and/or retraction of the ear piece from the auditory canal. The inflatable ear piece comprises one or more biasing means that are arranged to bias the inflatable part away from a totally collapsed state and into the deflated state. The biasing means is secured to an inner wall of the inflatable cavity.

The biasing means may be secured to the inner wall by means of an adhesive, which during manufacture is provided on the inner wall of the inflatable cavity and/or on an outer surface of the biasing means. Alternatively, or as supplement, the biasing means is/are made from a curable material, which when cured is caused to be cured onto the inner surface of the inflatable cavity.

In the latter case, the curable material and the inner wall may flow together and form a unitary element whereby the curable material and the inner wall cannot be detached from each other without causing permanent damage to one or both of the curable material and the inner wall. Accordingly in one embodiment, a seam is defined between the biasing means and the inner wall of the inflatable cavity. In the context of the present invention, the term 'seam' shall be understood such that when two materials are secured to each other without any securing means. e.g., an adhesive, a seam may be defined between the two materials. Examples of seams are welding seams and curing seams.

In one embodiment, the biasing means forms an integral part with the inner wall of the inflatable cavity. In one embodiment, the inner wall and the inflatable cavity (or a side wall thereof) forms a monolithic element, i.e. an element without seams defined between the inner wall and the inflatable cavity. The latter may be achieved by pouring the curable material into the inflatable cavity prior to the inner wall is fully cured during its manufacture.

In one embodiment, the biasing means comprises a silicone gel. Other examples of materials of the biasing means are polymers and rubber materials such as natural rubber and/or synthetic rubber.

BRIEF DESCRIPTION OF THE FIGURE

The invention will now be described with reference to the FIGURE in which:

FIG. 1 discloses an inflatable ear piece according to the invention.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE FIGURE

FIG. 1 discloses an inflatable ear piece 100 according to the invention. The inflatable ear piece 100 is adapted to be positioned in an auditory canal of a user and to be connected to a behind-the-ear part (not shown) via an interconnecting tube 102. The interconnecting tube 102 may be permanently or detachably secured to the inflatable ear piece 100 and/or the behind-the-ear piece (not shown).

The inflatable ear piece 100 defines an inflatable part 104 defining an inflatable cavity 106, which when inflated defines an inflated state in which an outer surface 108 of the inflatable part 104 abuts an inner surface (not shown) of the auditory canal (also not shown). Moreover, when deflated, the inflatable cavity 106 defines a deflated state in which it allows for insertion and/or retraction of the ear piece from the auditory canal. In FIG. 1, the inflatable cavity 106 is shown in its inflated state.

The inflatable ear piece 106 comprises a biasing means 110 which is arranged to bias the inflatable part 104 away from a totally collapsed state and into the deflated state. The biasing means 110 is secured to an inner wall 112 of the inflatable cavity 106. In FIG. 1, the biasing means 110 is secured to the proximal part of the inner wall 112 of inflatable cavity 106, i.e. close to the proximal tip 114 of the inflatable ear piece 100.

In the embodiment of FIG. 1, the interconnecting tube 102 extends through the inflatable part 104 and thus forms a part of the inner wall 112 of the inflatable cavity 106.

Each of these embodiments and obvious variations thereof is contemplated as falling within the spirit and scope of the claimed invention, which is set forth in the following claims.

What is claimed is:

1. A method of manufacturing an inflatable ear piece for a hearing aid, which inflatable ear piece is adapted to be inserted into an auditory canal of a user, the inflatable ear piece defining an inflatable cavity, which when inflated defines an inflated state in which the inflatable ear piece abuts an inner wall of the auditory canal, and when deflated defines a deflated state in which it allows for insertion and/or retraction of the inflatable ear piece from the auditory canal, the method comprising the steps of:

providing the inflatable ear piece;

providing a predetermined material in the inflatable cavity, wherein the predetermined material is a curable material;

securing the curable material to an inner surface of the inflatable cavity, so as to bias the inflatable cavity away from a totally collapsed state, wherein the securing includes curing the curable material; and providing an inflation structure to allow air to be blown into the inflatable cavity after insertion of the inflatable ear piece into the auditory canal and configured to allow air to escape from the inflatable cavity.

2. A method according to claim 1, wherein the step of providing the predetermined material comprises the step of: pouring the predetermined material into the inflatable cavity.

3. A method of manufacturing according to claim 1, wherein the step of curing the curable material comprises the steps of:

positioning the inflatable ear piece such that the curable material is located in a predetermined position, and curing the curable material while it is provided in the predetermined position.

4. A method of manufacturing according to claim 1, wherein the step of curing the curable material comprises continuously rotating the inflatable ear piece while curing the curing material.

5. A method of manufacturing according to claim 1, wherein the curable material is a silicone gel.

6. An inflatable ear piece for a hearing aid which inflatable ear piece is adapted to be positioned in an auditory canal of user and to be connected to a behind-the-ear part via at least an interconnecting tube, the inflatable ear piece defining an inflatable part, defining an inflatable cavity, which when inflated defines an inflated state in which the inflatable part abuts an inner wall of an auditory canal when provided therein, and a deflated state that allows for insertion and/or retraction of the ear piece from the auditory canal, the inflatable ear piece comprising:

one or more biasing means which are arranged to bias the inflatable part away from a totally collapsed state and into the deflated state, wherein the biasing means is secured to an inner wall of the inflatable cavity and is made from a curable material that is cured to secure the curable material to the inner wall of the inflatable cavity; and an inflation structure to allow air to be blown into the inflatable cavity after insertion of the inflatable ear piece into the auditory canal and configured to allow air to escape from the inflatable cavity.

7. An inflatable ear piece according to claim 6, wherein a seam is defined between the biasing means and the inner wall of the inflatable cavity.

8. An inflatable ear piece according to claim 6, wherein the biasing means forms an integral part with the inner wall of the inflatable cavity.

9. An inflatable ear piece according to claim 6, wherein the biasing means comprises a silicone gel.

* * * * *